US005572293A

United States Patent [19]

Kikuchi et al.

[11] Patent Number: 5,572,293

[45] Date of Patent: Nov. 5, 1996

[54] METHOD OF AND SYSTEM FOR CLEANING A CHARGE INDUCING MEMBER

[75] Inventors: Nobuo Kikuchi, Saitama-ken; Kouichi Yamazaki, Kanagawa-ken; Sadao Takahashi, Tokyo-to; Kentaro Matsumoto, Chiba-ken; Tadashi Hayakawa, Tokyo-to; Yoshiaki Miyashita, Kanagawa-ken; Takeshi Tabuchi; Hirohisa Ohtsuka, both of Saitama-ken; Takaaki Tawada, Kanagawa-ken, all of Japan

[73] Assignee: Ricoh Company, Ltd., Tokyo, Japan

[21] Appl. No.: 322,136

[22] Filed: Oct. 13, 1994

[30] Foreign Application Priority Data

Oct. 14, 1993 [JP] Japan ..... 5-256910
Nov. 9, 1993 [JP] Japan ..... 5-279818

[51] Int. Cl.[6] ..... G03G 15/02

[52] U.S. Cl. ..... 399/357; 361/225

[58] Field of Search ..... 355/219, 298; 361/221, 225; 15/256.15

[56] References Cited

U.S. PATENT DOCUMENTS

| | | | |
|---|---|---|---|
| 3,600,081 | 8/1971 | Egnaczak | 355/271 |
| 3,875,407 | 1/1975 | Hayne | 250/324 |
| 3,879,121 | 4/1975 | Simpson | 355/271 |
| 3,935,517 | 1/1976 | O'Brien | 317/262 A |
| 4,377,229 | 3/1983 | Miyashita et al. | 198/494 |
| 4,707,115 | 11/1987 | Bares | 15/256.51 X |
| 4,864,363 | 9/1989 | Shinada | 355/133 |
| 4,922,299 | 5/1990 | Uchimoto et al. | 355/219 |
| 5,012,093 | 4/1991 | Shimizu | 250/324 |
| 5,182,694 | 1/1993 | Endo | 361/229 |
| 5,392,099 | 2/1995 | Kusumoto et al. | 355/221 |
| 5,436,701 | 7/1995 | Shimojo et al. | 355/219 |

FOREIGN PATENT DOCUMENTS

| | | |
|---|---|---|
| 60-134275 | 7/1985 | Japan . |
| 3-101768 | 4/1991 | Japan . |
| 3-130787 | 6/1991 | Japan . |
| 2193159 | 2/1988 | United Kingdom . |

*Primary Examiner*—Thu Anh Dang
*Attorney, Agent, or Firm*—Lowe, Price, LeBlanc & Becker

[57] ABSTRACT

A system for cleaning a charge inducing member comprising a cleaning element for establishing relative lineal as well as rotary movement between the cleaning element and charge inducing member. Embodiments include various mechanisms for imparting axial reciprocal motion to the cleaning element and for disabling reciprocation of the cleaning element or separating the cleaning element and charging member from each other during sensitive portions of a photoduplication cycle.

53 Claims, 13 Drawing Sheets

METHOD OF AND SYSTEM FOR CLEANING A CHARGE INDUCING MEMBER

TECHNICAL FIELD

The present invention relates to contact charge inducing members for charging photoconductive elements, such as drums or belts. The invention has particular applicability to electrophotographic apparatus, such as copiers, printers, facsimile machines and the like.

BACKGROUND ART

Conventional electrophotographic apparatus, such as copiers, printers, facsimile machines, etc., comprise an imaging surface, such as a photoconductive element, normally in the form of a drum or belt. Arranged in timed sequence around the imaging surface are a plurality of processing stations for performing various functions. These processing stations may comprise stations for charging the imaging surface, electrostatically forming a latent image on the imaging surface, developing the latent electrostatic image with a developer commonly referred to as toner, transferring the developed image from the imaging surface to a substrate such as paper, feeding paper to the transferring station, cleaning the imaging surface, i.e., removing residual toner on the imaging surface, and fixing the transferred developed image on the paper.

A typical reproduction operation comprises charging the imaging surface, such as a photoconductive drum, and exposing the charged surface to a light pattern of an original image to be reproduced thereby selectively discharging the imaging surface in accordance with the original image. The resulting pattern of charged and discharged areas on the surface of the photoconductive drum forms an electrostatic charge pattern or electrostatic latent image conforming to the original image.

The latent electrostatic image is developed by contacting it with finely divided toner which is held by electrostatic force on the imaging surface. The toner image is transferred to a substrate, such as paper, in a transferring device into which paper is fed by a registration roller toward the drum in synchronization with drum rotation. As the leading edge of the paper abuts the drum, electrostatic forces adhere the two together, and the transferring device transfers a toner image from the photoconductive drum to the paper. After transfer, the toner image is fixed to form a permanent record.

Subsequent to development, and after transfer of the developed image to the paper, some toner inevitably remains on the photoconductive drum, held thereto by electrostatic and/or Van der Wals force. Additionally, other contaminants, such as paper fibers, toner additives, Kaolins and various other forms of debris, have a tendency to be attracted to the charge retentive surface.

Contemporary commercial automatic copiers/reproduction machines comprise an electrostatographic imaging surface, which may be in the form of a drum or belt. The imaging surface moves at high rates in timed unison relative to a plurality of processing stations. This rapid movement of the electrostatographic imaging surface requires vast amounts of toner to be employed during development. Associated with the increased amounts of toner is the difficulty in removing residual toner remaining on the imaging surface subsequent to transfer.

One type of device conventionally employed for charging the imaging surface of a photoconductive member is a corona charger normally positioned slightly spaced apart from the surface of the imaging surface for applying a surface charge thereto. Typically, a corona charging device comprises a wire electrode and a shield electrode to which is normally applied a relatively high voltage, on the order of 4 to 8 kilovolts, to induce 500 to 800 volts of surface potential on the imaging surface. Corona chargers are of relatively low charging efficiency, because most of the discharging current from the wire electrode flows to the shield electrode, leaving a small percentage of the total discharging current flowing to the imaging member to be charged. Another disadvantage attendant upon employing a corona charger is the generation of ozone which constitutes a health hazard and is, therefore, environmentally undesirable. Accordingly, when employing a corona charger it is necessary to install filtering and air distribution systems in any environment in which the electrostatographic apparatus is situated. In addition, image blurring occurs as a result of the oxidation of the image transfer components and deterioration of the photoconductive surface. Still another disadvantage attendant upon employing a corona charger is contamination of the wire electrode by fine dust attracted by the electrostatic field created by the electrode, thereby necessitating periodic cleaning and/or replacement of the wire electrode.

The disadvantages associated with corona chargers have led to the implementation of alternatives to the corona chargers, such as a contact type charge inducing member as disclosed in Japanese laid open 3-130,787. The disclosed system comprises a contact charge inducing member which is maintained in contact with the surface of a charge receiving member, e.g., a photoconductive drum, thereby charging the photoconductive drum at an advantageously relatively low voltage. Since a discharge is not established, ozone is not generated and the accumulation of dust on the wire electrode avoided.

As shown in FIG. 1, the prior art apparatus comprises photoconductive drum 60, a contact charge inducing member in the form of charging roller 62 connected to a relatively low voltage power supply 64 via conductive spring 61. The apparatus also comprises cleaning element 63 which is urged into contact with the surface of charging roller 62 upon energizing solenoid 65. Cleaning element 63 is made of felt, or a suitable foam such as a polyurethane, or a suitable elastomer such as an ethylene-propylene-diene-monomer (EPDM) elastomer. Solenoid 65 enables periodic movement of cleaning element 63 into and out of contact with charging roller 62.

In operation, solenoid 65 is normally off so that the armature extends out of solenoid 65 and cleaning element 63 is spaced apart from, i.e., out of contact with, charging roller 62. During operation, toner and other contaminants inevitably accumulate on charging roller 62, as from the surface of drum 60, decreasing its charge inducing efficiency. In addition, such toner and other contaminants tend to redeposit on photoconductive drum 60, resulting in poor quality reproductions. When solenoid 65 is switched on, the armature is drawn into the solenoid, extending cleaning element 63 into contact with charging roller 62 to remove toner and other contaminants therefrom while charging roller 62 rotates due to frictional engagement with photoconductive drum 60.

Another prior art cleaning element is disclosed in Japanese laid open 3-101,768. The cleaning element is also made of felt or other suitable materials, such as polyurethane foam or rubbers.

A conventional charging roller 62, as shown in FIG. 2A, normally comprises a conductive metal core 65 surrounded by a layer of elastomeric material 62*a*, such as rubber or an elastomeric resin, and a surface layer 62*b* having a thickness in the range of about 4 to about 14 microns and a hardness greater than that of underlying layer 62*a*.

Because the underlying layer 62*a* of elastomeric material is inherently formed with surface irregularities, as shown in FIG. 4, the outer surface layer 62*b* conforming to the shape of the underlying layer, is also irregular. This inherent irregular outer surface layer 62*b* is characterized by a convex and concave surface topography comprising crevices, recesses, etc., renders it particularly receptive to the accumulation of embedded or lodged finely divided material such as toner and other contaminants. Toner is a particularly troublesome contaminant, since its particle size is such that it easily penetrates crevices on the surface of a charge inducing member so that the toner tends to accumulate in the concave portions.

With reference to FIG. 2B, despite the use of the prior art cleaning elements, which were basically stationary while the charging roller rotates, toner and other contaminants (Tn) inevitably accumulate and lodge in crevices and recesses on the irregular surface of charging roller 62 (FIG. 2C). Such Tn tend to become embedded or lodged between charging roller 62 and cleaning element 63 as shown in FIG. 3, resulting in the accumulation of Tn on the surface of charging roller 62. In addition, the accumulation of Tn between cleaning element 63 and charging roller 62 creates friction on the surface of charging roller 62 thereby disadvantageously imparting vibrations to the photoconductive element resulting in poor quality reproduction. After a period of time, the accumulated Tn causes nonuniform charging resulting noticeably poor quality reproductions.

With reference now to FIGS. 5A and 5B, an area 70 of the surface of charging roller 62, having the irregular surface as shown in FIG. 4, has been cleaned by a prior art rotational element 63. The surface is characterized by an overlapping area 71 which has not been effectively cleaned by the prior art rotational cleaning element 63 due to poor contact therebetween because of the irregular surfaces of both the cleaning element and rotational element. This is because area 71 is in the "shadow" of area 70 and will not be "seen" by element 62 as it sweeps over the rotational element 63. Thus, as illustrated in FIG. 6A, accumulated Tn will remain embedded in surface crevices and recesses 62C, even after cleaning.

Several prior art techniques have been developed to remove toner and other contaminants from a photoconductive drum after transfer of the developed image to a substrate. See, for example, Japanese laid open 60-134275.

DISCLOSURE OF THE INVENTION

An object of the present invention is an electrostatographic apparatus which reproduces images having improved quality.

Another object is improved cleaning of a direct contact type charge inducing member.

Another object of the invention is improved cleaning of a direct contact type charge inducing member for charging a photoconductive element of an electrographic image forming apparatus.

A further object is more effective removal of accumulated toner and other contaminants from the surface of a direct contact type charge inducing member of a photocopier or other electrostatic image forming apparatus.

A still further object of the invention is in prolonging the life of a direct contact type charge inducing member.

Additional objects, advantages and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

According to the present invention, the foregoing and other objects are achieved in part by an apparatus comprising a charge receiving member upon which an electrostatic charge is to be formed, an electric charge inducing member positioned for inducing an electric charge on the charge receiving member, a cleaning element for cleaning the charge inducing member, and means for maintaining the cleaning element and the charge inducing member in contact with each other while imparting relative lineal motion therebetween.

Another aspect of the invention is an electrostatic image forming apparatus having a photoconductive element, such as a rotating photoconductive drum, upon which an electrostatic latent image is to be formed, a toner dispenser for transferring toner to the photoconductive drum, an electric charge inducing member, and positioning means for positioning the electric charge inducing member in direct surface engagement with the photoconductive drum. A source of electric potential is provided to establish an electric field between the charge inducing member and the photoconductive drum. The apparatus further includes means for advancing a substrate, such as paper, to the photoconductive drum and means for transferring a toner developed image corresponding to the latent image from the photoconductive drum to the paper. In accordance with the invention, there is included a cleaning element for cleaning the charge inducing member, and means for maintaining the cleaning element and charge inducing member in direct surface engagement with each other while imparting relative lineal motion therebetween.

A further aspect of the invention is an apparatus comprising a photoconductive drum spaced apart from a cleaning element by a distance greater than the diameter of an electric charge inducing roller positioned therebetween. Means are provided for moving the electric charge inducing roller into direct contact with either the photoconductive drum or the cleaning element, but not into direct contact with both the charge inducing roller and the photoconductive drum at the same time. An electric field is established between the electric charge inducing roller and the photoconductive drum only when the charge inducing roller and the photoconductive drum are in direct contact with each other, and the motion imparting means imparts relative lineal motion between the charge inducing roller and cleaning element only when the charge inducing roller and cleaning element are in direct contact with each other.

Still another aspect of the invention is an apparatus comprising a photoconductive drum, charge inducing roller, cleaning element, and motion imparting means for imparting relative substantially axial motion between the cleaning element and charge inducing roller during only a fraction of the time the photoconductive drum rotates.

A further aspect of the invention is a method of cleaning an electric charge inducing roller by positioning a cleaning element in direct contact with the charge inducing member, and rotating the charge inducing member while establishing relative substantially axial movement between the cleaning element and the charge inducing member.

DESCRIPTION OF THE INVENTION

Figure 7:
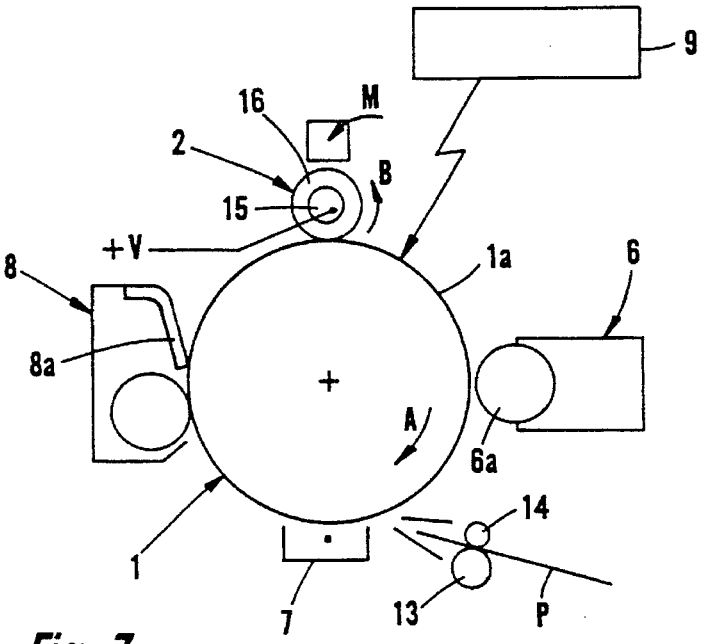
FIG. 7 is a schematic of an image forming apparatus of a type in which the present invention is advantageously incorporated.

The present invention concerns an apparatus comprising a charge receiving member, a charge inducing member for charging the charge receiving member, a cleaning element for removing toner and other contaminants from the charge inducing member, and motion imparting means for maintaining the cleaning element and charge inducing member in contact with each other while imparting relative lineal motion between them. An apparatus in which the cleaning system of the invention is applicable is an image forming apparatus, such as a typical electrostatic image apparatus comprising a photoconductive drum as the charge receiving member and a charging roller as the charge inducing member as shown in FIG. 7. Photoconductive drum 1 comprises an electrically conductive base and photoconductive layer 1*a*, such as a photoconductive semiconductor layer of an organic photoconductor, amorphous silicon, selenium or the like. Photoconductive drum 1 rotates, driven by a motor, timing belt and pulley arrangement (not shown), at a predetermined speed in the direction indicated by arrow A sequentially in relation to a plurality of processing stations disposed about its rotational path of movement. As used herein, "downstream" refers to a location along photoconductive drum 1 in the process direction, while "upstream" refers to a location along the circumference of photoconductive drum 1 in a direction opposite the process direction.

With continued reference to FIG. 7, charging roller 2 initially contacts the surface of photoconductive drum 1 under a predetermined pressure and rotates in the direction indicated by arrow B following the rotation of photoconductive drum 1. Charging roller 2, supplied with a voltage V from an external source, charges photoconductive drum 1 to a substantially uniform potential, either positive or negative. Downstream at station 9, light rays reflected from an original document are reflected through a lens and projected onto a charged portion of the surface of photoconductive drum 1 to selectively dissipate the charge thereon. Such selective charge dissipation records an electrostatic latent image on the circumference of photoconductive drum 1 corresponding to the informational area contained within an original document. Alternatively, a laser may be provided to imagewise discharge the photoconductive drum 1 in accordance with stored electronic information.

Thereafter, photoconductive drum 1 rotates downstream to development station 6 where a rotating magnetic member 6*a* advances a developer mix (e.g., carrier particles and toner) into contact with the latent electrostatic image. The toner particles are attracted away from the carrier beads by the latent electrostatic image, thereby forming toner powder images on the surface of photoconductive drum 1. The development station may apply one or more colors of developer material.

Photoconductive drum 1 then rotates downstream advancing the developed latent image to transfer station 7 having an endless belt (not shown). At transfer station 7, a sheet of support material or substrate, such as a paper copy sheet P, is advanced into contact with the developed latent images by cooperating register roller 13 and pressure roller 14. The toner powder image is transferred from photoconductive drum 1 to paper P. After transfer, the toner image is fused on paper P by a fusing device (not shown) and paper P stripped from the endless belt and fed to a discharge tray (not shown). Residual toner on photoconductive drum 1 is removed at downstream cleaning station 8 by cleaning blade 8*a*. Any remaining electric charge on photoconductive drum 1 is removed by a downstream discharging unit (not shown) and the photoconductive drum 1 is then ready to be charged again by charging roller 2.

The apparatus illustrated in FIG. 7 utilizes a charging roller 2 rather than a corona charging device and, therefore, avoids its known disadvantages. However, as previously noted, a disadvantage of a charging roller is the accumulation of toner and other contaminants on the surface of the charging roller. The present invention, shown schematically as element M in FIG. 7, confronts and solves the prior art problem of ineffective cleaning of accumulated toner and other contaminants on the irregular surface of a charge inducing member by establishing relative lineal movement, preferably relative substantially axial movement, between a cleaning element and charge inducing member, to effectively remove accumulated toner and other contaminants embedded in topographical recesses and crevices on the surface of a charge inducing member. This enables the charge inducing member to be maintained free from toner and other contaminants for extended periods of time and enabling higher quality reproductions.

Relative lineal movement between the charge inducing member and cleaning element can be established by employing means for establishing lineal movement of the charging roller and/or means for establishing lineal movement of the charge inducing member. It is preferred, however, to maintain the charge inducing member stationary in its axial direction and employ means for reciprocally moving the cleaning element in a substantially axial direction.

Figure 8A:
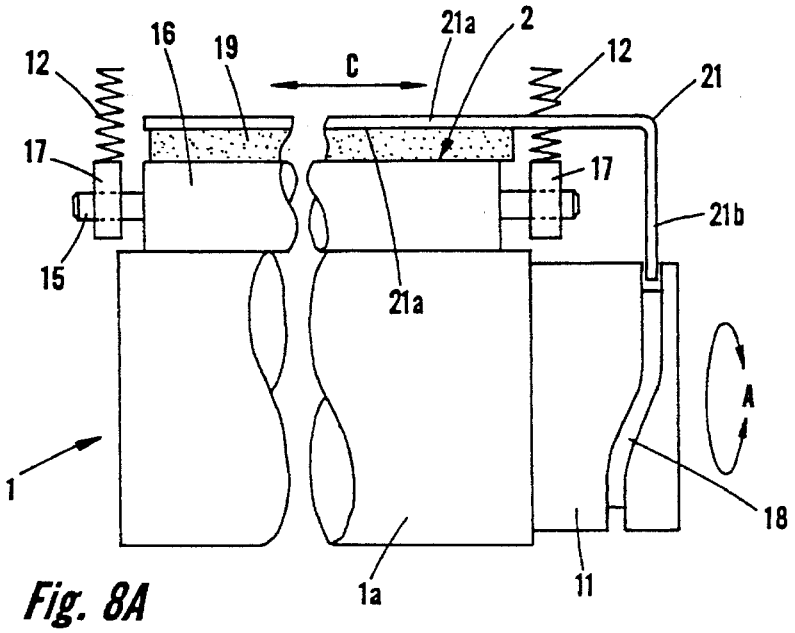
FIG. 8A is a schematic of a portion of an image forming apparatus comprising an embodiment of the present invention.
Figure 8B:
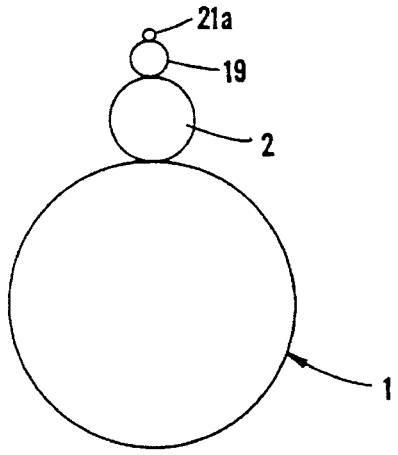
FIG. 8B is an enlarged partial end view of the embodiment shown in FIG. 8A.

An embodiment of the present invention is shown in FIGS. 8A and 8B, wherein photoconductive drum 1 is charged by charging roller 2 when charging roller 2 is urged against photoconductive drum 1 by springs 12. Charging roller 2 can be a conventional charging roller comprising metal core rod 15 and surrounding elastomeric layer 16, such as an EPDM elastomer. Metal core rod 15 is rotatably supported by bearings 17 at both ends. In this embodiment, charging roller 2 is not driven independently, but rotates by virtue of frictional contact with photoconductive drum 1. One end of photoconductive drum 1 is provided with cam 11 containing circumferential groove 18 having a predetermined pattern. An L-shaped holder 21 is affixed to cleaning element 19 at the lower surface of leg 21*a*, while leg 21*b*, functioning as a cam follower, is slidably engaged in circumferential groove 18 of cam 11. A guide (not shown) may be provided to maintain the position of leg 21*b* in circumferential grove 18. By appropriate design of the pattern of circumferential groove 18, upon rotation of photoconductive drum 1 in the direction indicated by arrow A, cam 11 makes one complete rotation with the cam follower 21*b*, thereby reciprocating cleaning element 19 in a substantially axial direction indicated by arrow C, establishing relative substantially axial movement between charging roller 1 and cleaning element 19 in addition to relative rotational movement therebetween. By effecting relative substantially axially movement between charging roller 2 and cleaning element 19, toner and other contaminants can be effectively removed from topographical crevices and recesses in the irregular surface of charging roller 2, thereby preventing their accumulation maintaining charging roller 2 free from toner and other containments for long periods of time and improving the quality of reproductions.

Cleaning element 19 can be made of any suitable material capable of dislodging toner and other contaminants from the irregular surface of charging roller 2. Suitable materials include felt, a sponge-like material or foam, such as polyurethane, and an elastomeric material of suitable hardness such as a polyurethane rubber.

Figure 1:
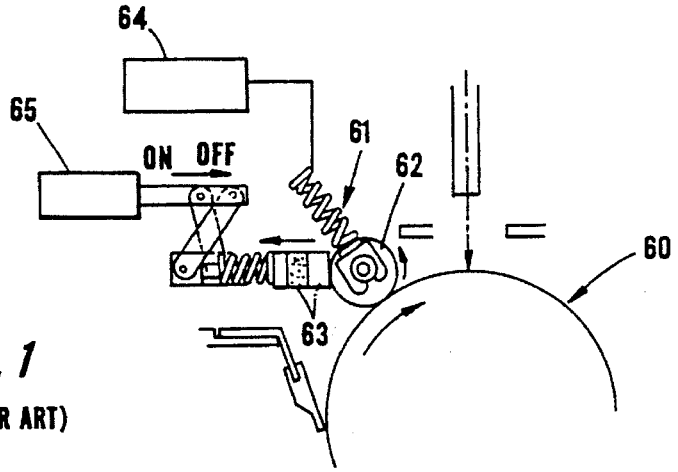
Fig. 1 (PRIOR ART)
FIG. 1 is a schematic of a portion of an image forming apparatus containing a prior art cleaning element.

In the embodiment depicted in FIGS. 8A and 8B, the movement of cleaning element 19 is determined by the design of circumferential groove 18. The advantages of this embodiment reside in its relatively simple mechanism employing cam 11, circumferential groove 18 and holder 21 to effect relative lineal movement between charging roller 2 and cleaning element 19. Such relative lineal movement prevents toner and other contaminants from entering and/or accumulating between cleaning element 19 and charging roller 2, whereas conventional cleaning elements, such as that shown in FIG. 1 which are incapable of establishing relative lineal movement with respect to the charging roller, cannot prevent such entry and/or accumulation of toner and other containments.

Figure 9:
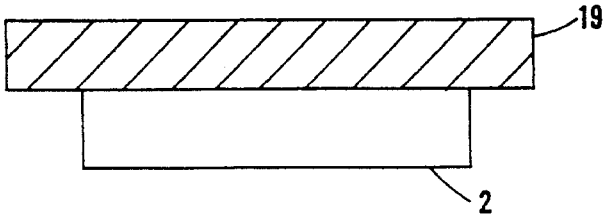
FIG. 9 shows a preferred geometric relationship between the cleaning element and the charging roller.

Normally, the length of the cleaning element of the present invention is no less than the length of the portion of the charge inducing member that contacts or charges the charge receiving member, i.e., the imaging length of the charge inducing member. Thus, the cleaning element is of sufficient length so that, when positioned during cleaning, it extends to at least the ends of the charge inducing member. It is preferred that the length of the cleaning element is greater than the imaging length of the charge inducing member, so that the portion of the cleaning element that contacts the imaging length of the charge receiving member is always maintained free of toner and other contaminants. It is most preferred that the cleaning element has a length such that, when positioned during cleaning, the cleaning element always extends beyond each end of the charge inducing member. One such preferred embodiment is shown in FIG. 9 wherein cleaning element 19 extends beyond each end of charge inducing member 2.

With reference to the embodiment shown in FIGS. 8A and 8B, the cycles of repetitive substantially axial movement of cleaning element 19 differ from, i.e., are nonintegral or nonsynchronized with the rotational cycles of charging roller 2. Preferably, the repetition rate of substantially axial movement of cleaning element 19 is greater than the cycles of rotation of charging roller 2. In a more preferred aspect of the invention, about one revolution of charging roller 2 corresponds to from about 1.5 to about 3.5 cycles of substantially axial reciprocal movement of cleaning element 19, most preferably 2.5 cycles of axial reciprocal movement of cleaning element 19.

It is also a preferred aspect of the invention that the speed of movement of the cleaning element in one substantially axial direction is greater than that in the opposite direction, preferably from 1.5 to 2 times. In this way, more effective cleaning can be obtained, depending on the particular circumstances.

We have observed that as the cleaning element rotates while in contact with rotating charging roller, vibrations can be induced in the photoconductive drum which may adversely affect the reproductions, as by causing blurred images. The embodiment of the present invention shown in FIG. 10, which is a variation of the embodiment shown in FIGS. 8A and 8B, avoids the generation of vibration in photoconductive drum 1 by virtue of clutch mechanism 24. Elements in FIG. 10 similar in function to those in FIG. 8A bear similar reference numerals. In accordance with the FIG. 10 embodiment of the invention, clutch 24, preferably an electromagnetic clutch, is positioned between photoconductive drum 1 and cam 11. Electromagnetic clutch 24 disengages cam 11 from photoconductive drum 1 so that cleaning element 19 does not reciprocate linealy during sensitive phases of the reproduction process, such as exposure of the photoconductive drum 1, development of the latent electrostatic image and transfer of the developed image. As in the FIG. 8A embodiment, the movement of cleaning element 19 is determined by the design of circumferential groove 18 in cam 11.

Figure 10:
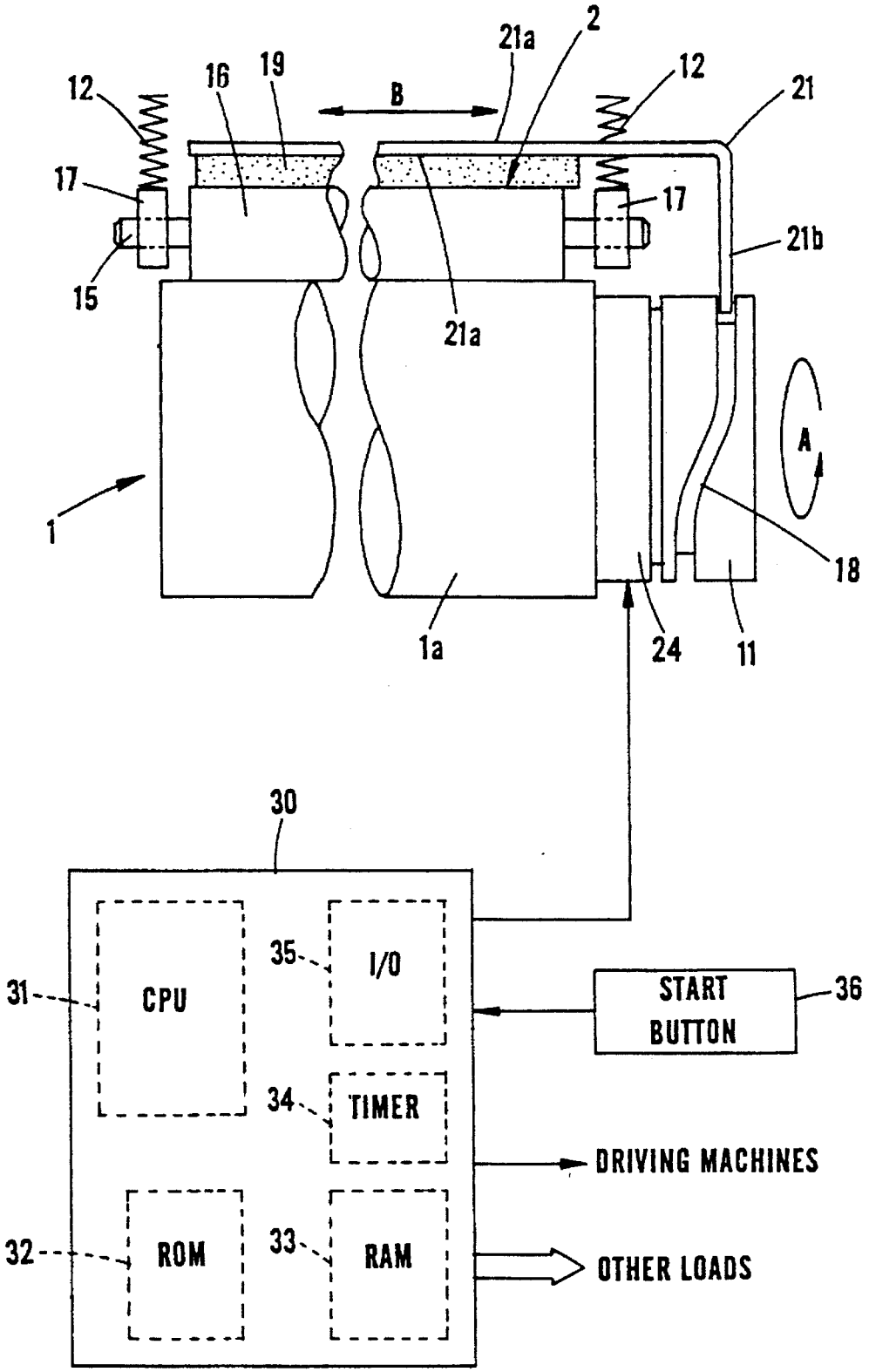
FIG. 10 is a schematic of a portion of an image forming apparatus comprising another embodiment of the present invention.

Also shown in FIG. 10 is a basic microprocessor 30 comprising CPU 31, ROM 21 having a suitable program enabling cleaning element 11 to reciprocate linearly only during non-sensitive phases of development, RAM 33 which stores the input data from CPU 31, timer 34, and I/O 35. ROM 32 is preferably programmed so that the cleaning element 19 reciprocates only during the time that photoconductive drum 1 is not being exposed. Also shown is start button 36, positioned on an operations panel (not shown), for transmitting an initiation signal to controller 30. The operations panel may also contain means for displaying and selecting paper size, brightness or toner density, enlargement, reduction, color, number of sides reproduced, number of copies, and means for displaying instructions and trouble-shooting information.

In operation, when button 36 is depressed, a signal is sent to controller 30, together with data from selections on the operations panel, such as paper size and toner density. Controller 30 then outputs a signal to drive the motor (not shown) of photoconductive drum 1 and signals to drive the other elements of the apparatus, including signals to light the apparatus panel (not shown). Controller 30 also generates an output signal to engage cam 11 to photoconductive drum 1. In the embodiment depicted in FIG. 10, a voltage source (not shown) generates a potential, for example of −500 volts, which passes through conductive spring 12, and conductive bearing 17 to conductive core 15 of charging roller 2.

Figure 11A:
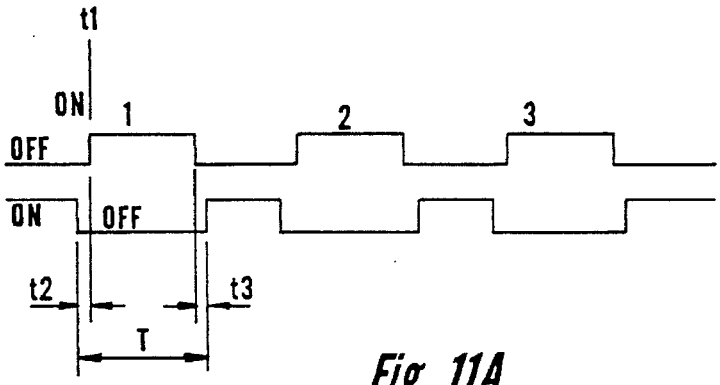
FIGS. 11A and 11B depict timing charts showing operation of an embodiment of the present invention.
Figure 11B:
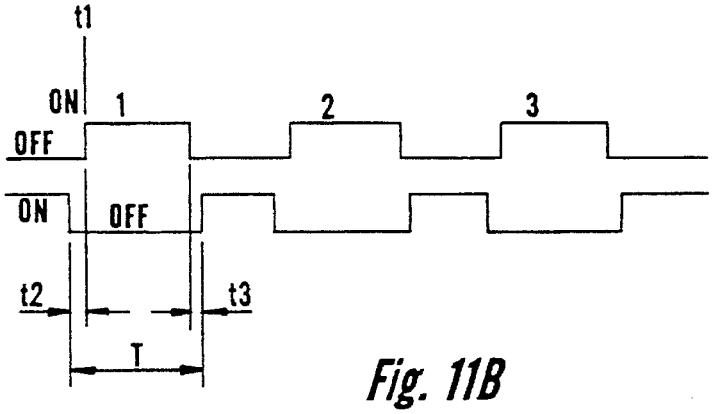

FIGS. 11A and 11B show signal timing charts illustrating operation of the embodiment of FIG. 10. Cam 11 is selectively decoupled from photoconductive drum 1 during exposure (FIG. 11A) and transfer (FIG. 11B) to avoid blurred reproductions due to vibrations caused by lineal reciprocation of cleaning element 19. As shown in FIGS. 11A and 11B, electromagnetic clutch 20 is disengaged, thereby decoupling cam 11 from photoconductive drum 1 at t2 prior to the initiation of exposure or transfer at t1. Exposure and transfer are completed after time T. Electromagnetic clutch 20 is subsequently engaged, thereby coupling cam 11 to photoconductive drum 1 and resuming reciprocation of cleaning element 19, subsequently at time t3. Thus, electromagnetic clutch periodically disengages and engages, as shown in second and third cycles, to decouple cam 11 and, hence, prevent lineal reciprocation of cleaning element 19 during sensitive phases of operation, thereby avoiding blurred reproductions due to induced vibrations.

Figure 12:
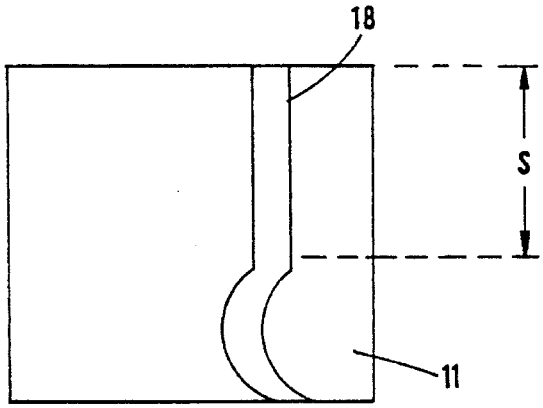
FIG. 12 shows a circumferential groove design for controlling reciprocation of the cleaning element.

FIG. 12 shows another embodiment of the present invention designed to avoid blurred reproductions due to vibrations induced in the photoconductive drum by lineal reciprocation of the cleaning element in contact with the charging roller during sensitive phases of rotation of the photosensitive drum. As seen in FIG. 12, the patterned circumferential groove 18 in cam 11 is designed with a relatively straight segment S. With reference to FIGS. 10 and 12, it should be apparent that while leg 21*b* is slidably engaged in straight segment S of circumferential groove 18, holder 21 and, consequently, cleaning element 19, do not reciprocate linearly. This elegantly simple technique eliminates the need for an electromagnetic clutch 24 and, advantageously, ceases lineal reciprocation of cleaning element 19 during sensitive phases of the reproduction process, such as exposure, development, and transfer.

In a preferred embodiment of the present invention, the means for establishing relative lineal movement between the cleaning element and charge inducing member comprises two separate elements such as motors, one motor coupled to the charge inducing member and the other connected to the cleaning element. For example, one motor is coupled to a charging roller for inducing rotational movement, and a separate motor connected to a cleaning element for inducing reciprocal lineal movement. The provision of two separate motors affords the advantage of controlling nonintegral or nonsynchronized movement of the charging roller and cleaning element. Thus, the rate at which the cleaning element reciprocates linealy can be controlled in relation to the rate at which the charging roller rotates. Nonsynchronized or nonintegral lineal reciprocation and rotation enables more efficient cleaning of the charging roller by the cleaning element, as by removing deeply embedded toner or other contaminants. Preferably, for each revolution of the charging roller, the cleaning element is reciprocated linearly about 1½ to about 2½ strokes, but preferably about 2½ strokes or thrusts of the cleaning element per revolution of the charging roller. In addition, it is preferred to move the cleaning element at different velocities in opposite directions. This additional flexibility enables cleaning in only one lineal direction when desirable under the particular circumstances.

Figure 13:
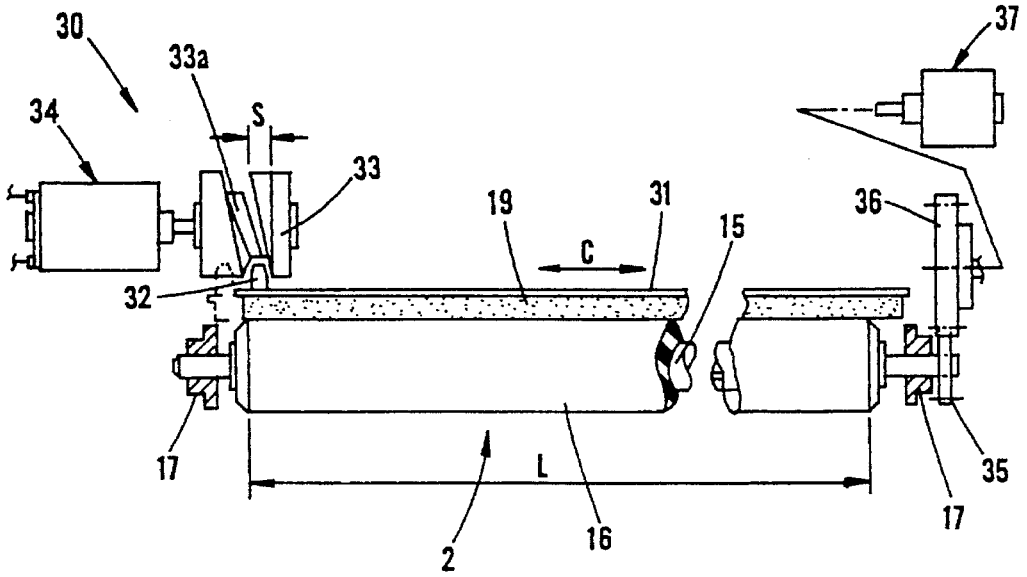
FIG. 13 is a schematic of a portion of an image forming apparatus comprising another embodiment of the present invention.

One preferred embodiment wherein means are provided for nonsynchronized lineal reciprocation of the cleaning element and rotation of the charging roller is shown in FIG. 13 wherein motor 34 effects reciprocal movement of cleaning element 19 in a substantially axial direction, and motor 37 effects rotational movement of charging roller 2. Preferably, the length of cleaning element 19 is greater than the length L of the image forming portion of charging roller 2, i.e., the portion of charging roller 2 that directly contacts and charges the image forming portion of the photoconductive drum (not shown).

Figure 2A:
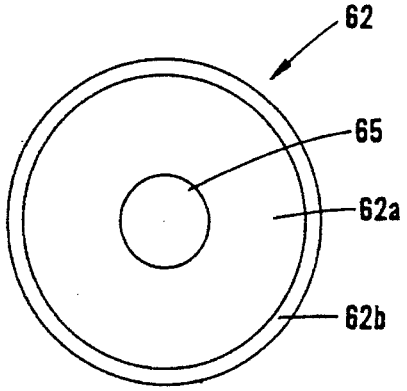
Fig. 2A (PRIOR ART)
FIG. 2A is a cross sectional view of a conventional charging roller.
Figure 2B:
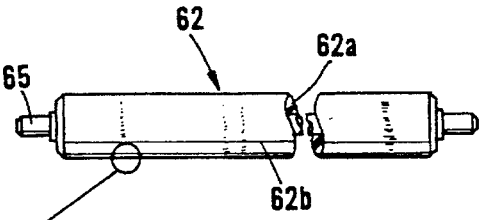
Fig. 2B (PRIOR ART)
FIG. 2B is a schematic of a charging roller showing accumulated contamination.
Figure 2C:
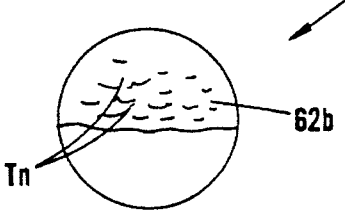
Fig. 2C (PRIOR ART)
FIG. 2C shows a surface detail of the conventional roller.
Figure 3:
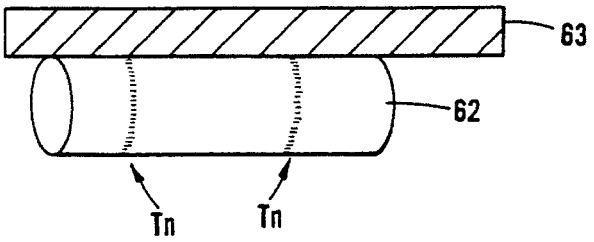
Fig. 3 (PRIOR ART)
FIG. 3 shows contaminants lodged between a charge inducing member and cleaning element.
Figure 4:
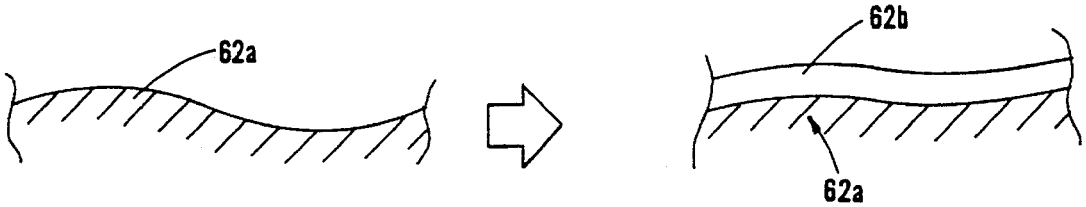
Fig. 4 (PRIOR ART)
FIG. 4 shows why an irregular topology tends to be formed on the surface of a charge inducing member.
Figure 5A:
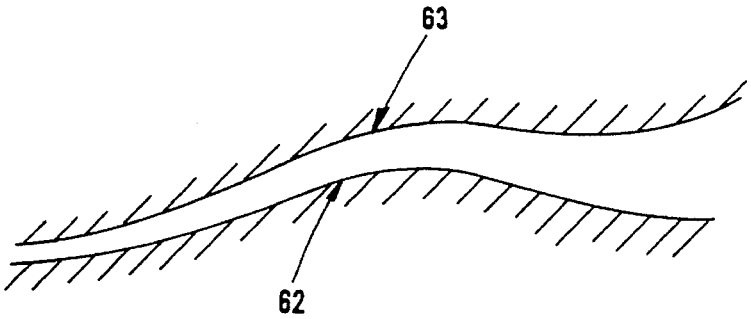
Fig. 5A (PRIOR ART)
FIGS. 5A and 5B show contamination resulting from nonuniform cleaning employing prior art cleaning elements.
Figure 5B:
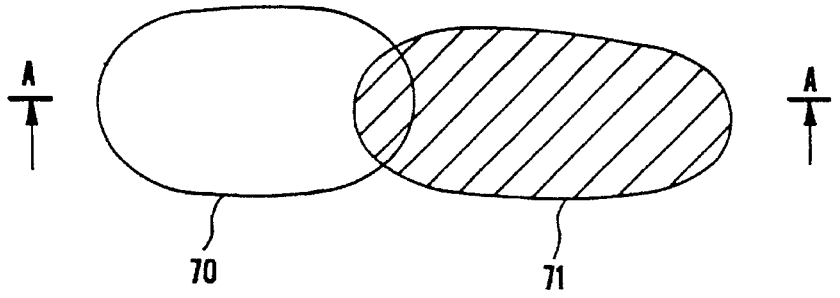
Fig. 5B (PRIOR ART)

Charging roller 2 is similar in structure to that shown in FIG. 2A in that it comprises a conductive metal core rod 15, and an intermediate layer (not shown in FIG. 13) of an elastomeric material having higher resiliency than the elastomeric material of the outer surface layer. The outer surface layer 16 preferably has a thickness ranging from about 7 μm to about 13.4 μm. In a preferred aspect of this embodiment, the intermediate layer is an epichlorohydron rubber and the surface layer 16 is a material comprising an epichlorohydron rubber and a fluorine compound, such as copolymer of fluoro-olefin and hydrocarbon vinylether.

With continued reference to FIG. 13, bracket 31 is affixed to the outer surface of cleaning element 19. Leg 32 of bracket 31 slidably engages circumferential groove 33*a* in cam 33 connected to motor 34. Charging roller 2 is mounted on conductive bearings 17 via core 15 which is connected to gear 35 that, in turn, engages driving gear 36 driven by motor 37. Thus, charging roller 2 is driven rotationally by motor 37. Motor 34, which operates independent of motor 37, can be programmed to advantageously operate during appropriate nonsensitive phases of the reproduction process to reciprocate cleaning element 19 linealy and to be nonoperational during sensitive phases of the reproduction process, such as exposure, development and transfer.

Figure 14:
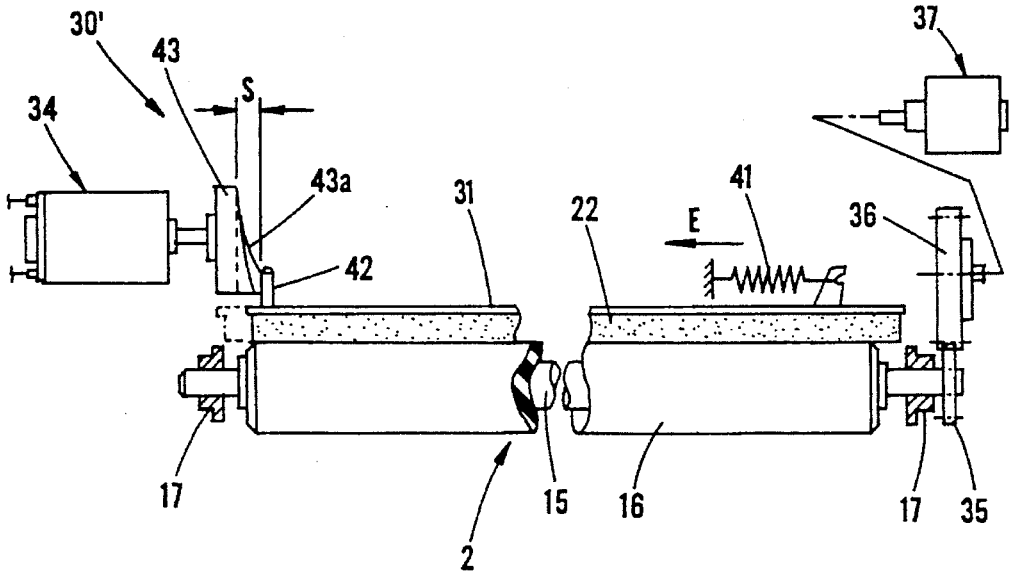
FIG. 14 is a schematic of a portion of an image forming apparatus comprising yet another embodiment of the present invention.

The embodiment of the present invention, shown in FIG. 14, is similar to the embodiment shown in FIG. 13, and, therefore, similar elements are represented by similar reference numerals. The FIG. 14 embodiment differs from the FIG. 13 embodiment in that cam 33 containing circumferential groove 33*a* is replaced with cam 43 having a surface pattern 43*a* which is traced by leg 42 of bracket 31. Leg 42 is urged against surface pattern 43*a* by spring 41.

In the FIG. 13 and FIG. 14 embodiments, S represents the distance travelled by leg 32 or leg 42, respectively, to effect one thrust or one half of a lineal reciprocation of cleaning element 19. With reference to FIGS. 13 and 14, the velocity of cleaning element 19 is determined by the design of circumferential groove 33*a* (FIG. 13) or the shape of cam surface 43*a* (FIG. 14). Therefore, circumferential groove 33*a* (FIG. 13) and cam surface 43*a* (FIG. 14) can be designed so that cleaning element 19 moves slower in one reciprocating direction than in the opposite reciprocating direction for highly effective cleaning.

Figure 15A:
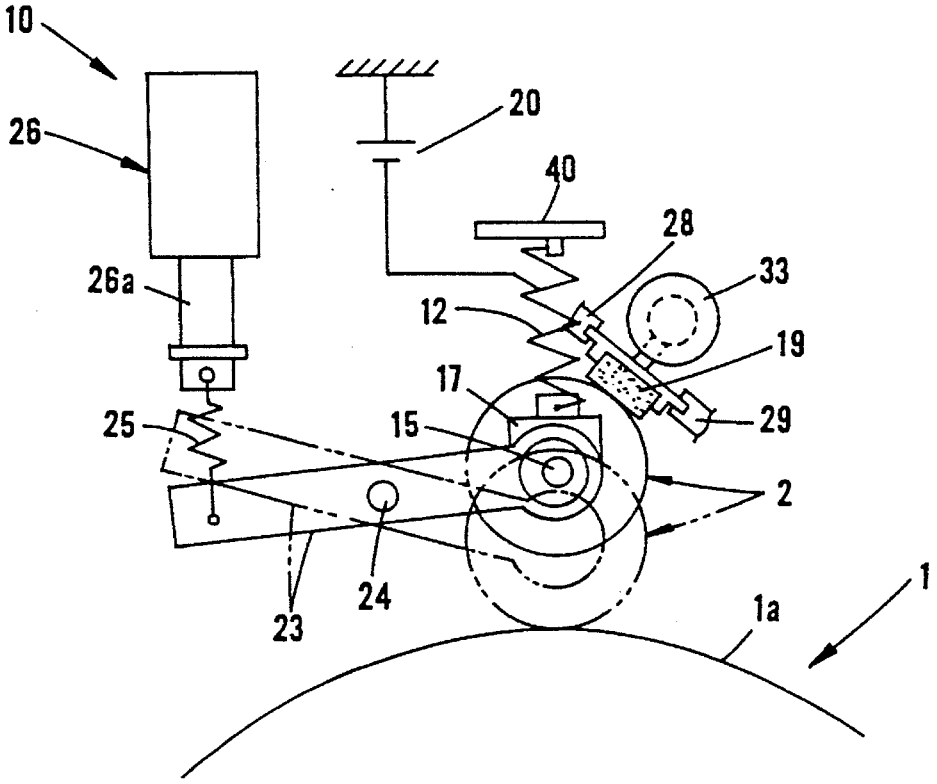
FIGS. 15A, 15B and 15C show another embodiment of the present invention employing a charging roller positioning mechanism.

Thus, separate motors are advantageously employed to effect rotation of the charging roller and lineal reciprocation of the cleaning element. During cleaning, relative rotational and lineal movement occurs between the charging roller and cleaning element, thereby effectively dislodging toner and other contaminants from the irregular surface of the charging roller. However, in operation, when electric poser is supplied to the charging roller to charge the photoconductive drum, static electricity is generated with attracts toner and other contaminants from the cleaning element to the charging roller because the cleaning element is in contact with the charging roller. Accordingly, a preferred variation of the embodiments shown in FIGS. 13 and 14 is shown in FIG. 15A which further includes means to move the charging roller 2 from a position in contact with the photoconductive drum 1 to effect charging thereof, and to a second position out of contact with photoconductive drum 1 but in contact with the cleaning element 19 at which time relative lineal and rotational movement is established therebetween to effect cleaning. This preferred embodiment advantageously avoids inducing vibrations in photoconductive drum 1 and, thereby, avoids blurred reproductions.

Figure 15B:
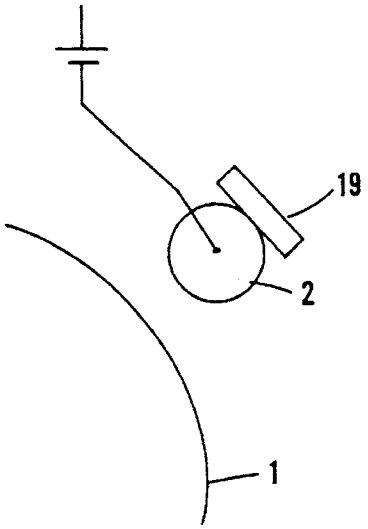

Such preferred embodiment shown in FIG. 15A can be employed with the FIGS. 13 and 14 embodiments. With reference to FIGS. 13, 14 and 15A, charging roller 2 is mounted via rod 15 to conductive bearing 17, which is connected to power supply 20 via conductive spring 12 fixed at 40. Arm 23, pivoted at 24, is linked at one end to spring 25 and at its other end to conductive bearing 17 via rod 15. Mechanism 10 pivots charging roller 2 selectively into contact with the photoconductive drum 1 for charging (shown in FIG. 15C), or out of contact with photoconductive drum 1 and into contact with cleaning element 19 (shown in FIG. 15B) and into engagement with gear 35 driven via gear 36 by motor 37 to effect rotational movement of charging roller 2. At the same time, motor 34 reciprocates cleaning element 19 in a substantially axial direction so that both relative rotational and relative lineal movement is established between charging roller 2 and cleaning element 19 to effectively remove toner and other contaminants from the irregular surface of charging roller 2. Moreover, such cleaning is effected without inducing vibrations in photoconductive drum 1, thereby avoiding blurred images.

Figure 15C:
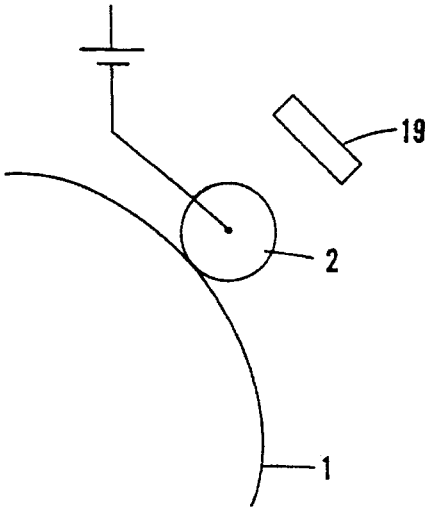

In operation, when solenoid 26 is switched on, rod 26*a* withdraws and charging roller 2 is brought into contact with photoconductive drum 1 as shown in FIG. 15C and by phantom lines in FIG. 15A. When solenoid 26 is switched off, movable rod 26*a* extends thereby moving charging roller 2 out of contact with photoconductive drum 1 and into contact with cleaning element 22 (FIG. 15B) which linealy reciprocates in guides 28 and 29 driven by motor 34. Advantageously, when power is supplied to charging roller 2, it is not in contact with cleaning element 19, thereby avoiding the transfer of toner and other contaminants back to charging roller 2 from cleaning element 19 due to static electricity. Another advantage of this embodiment is that the motor 34 is not always on thereby extending the life of the components as well as down time on the machine.

Advantageously, the rotational movement of charging roller 2 is nonsynchronized with respect to the reciprocating lineal movement of cleaning element 19. Thus, one rotation of charging roller 2 does not correspond to one complete lineal reciprocation of cleaning element 19. Preferably, for every complete revolution of charging roller 2, cleaning element 19 reciprocates 1 to 4 times, preferably twice.

Figure 14A:
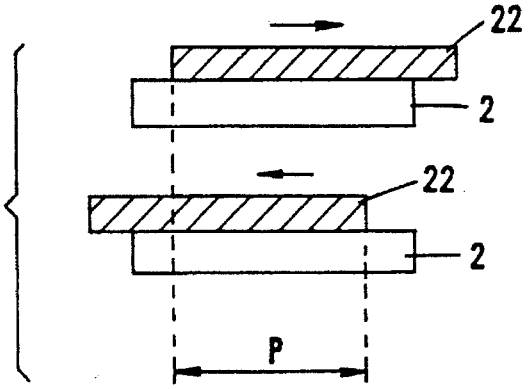
FIG. 14A shows why the length of the cleaning element may be less than that of the charging roller.

As in other embodiments, it is preferred that cleaning element 19 has a length greater than the length of charging roller 2. Preferably, at least one end of the cleaning element 19 extends beyond one end of charging roller 2. In the embodiments shown, each end of cleaning element 19 extends beyond each end of charging roller 2. In this way, the entire charging portion of charging roller 2 is freed from toner and other contaminants. Thus, as a result of the nonsynchronized movement of the charging roller 2 with respect to cleaning element 19, and the relative rotational and reciprocal motion established therebetween, the same portion of charging roller 2 is not always cleaned by cleaning element 19 and the entire charging portion of charging roller 2 is effectively cleaned. Alternatively, however, the length of the cleaning element may be the same, or even less, than that of charging roller 2, provided the thrust of the cleaning element is sufficient to cover at least the region P of the surface of the roller, as shown in FIG. 14A, corresponding to the image forming region of the photoconductive drum 1.

It is also possible to replace both motor 34 and 37 with a single motor and a transmission between the motor and charging roller 2 of cleaning element 22 to effect similar results. One having ordinary skill in the art would recognize that the present invention employing nonsynchronized or independent rotational and lineal reciprocating movements, and means to move a charge inducing member into and out of contact with a charge receiving member, is not confined to the embodiments shown in FIGS. 13, 14, 15A, 15B and 15C. Rather, the present invention encompasses all variations of that basic concept.

Figure 16:
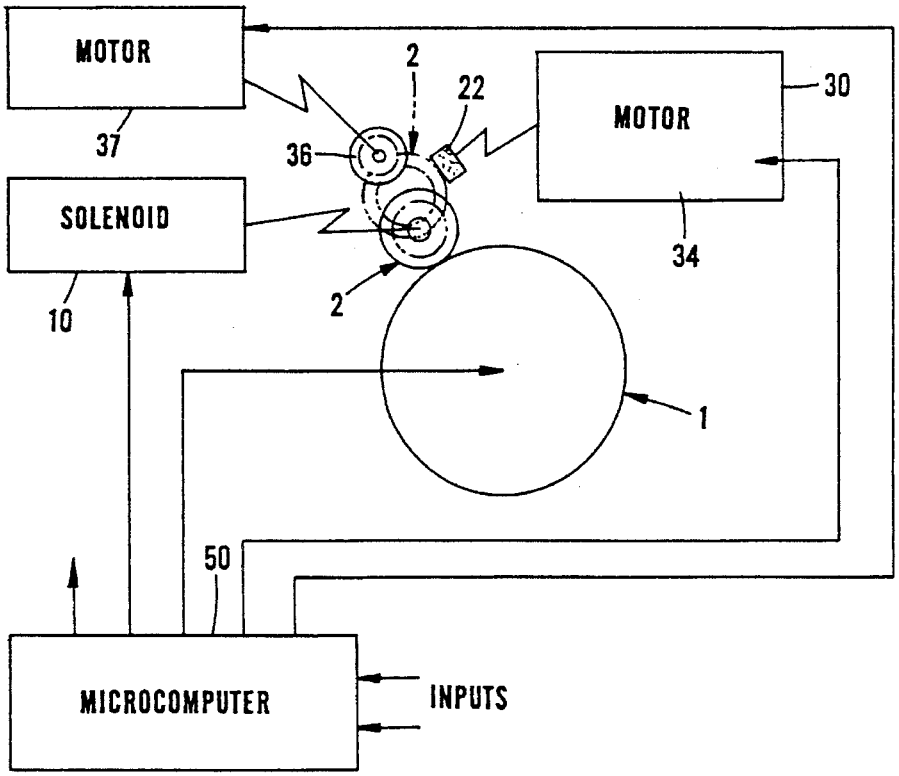
FIG. 16 is a block diagram showing operation of the FIG. 15A embodiment of the present invention.

FIG. 16 is a block diagram showing operation of the FIG. 15A embodiment of the present invention. Shown in FIG. 16 are microcomputer 50 which controls solenoid 10, motor 37 and motor 34. FIG. 7 is a flow chart showing the control flow of the microcomputer 50. Upon engaging the start button (not shown), microcomputer 50 causes photoconductive drum 1 to rotate, solenoid mechanism 10 to move charging roller 2 into and out of contact with photoconductive drum 1, and motors 34 and 37 to operate according to the prescribed program described in FIG. 17.

Figure 17:
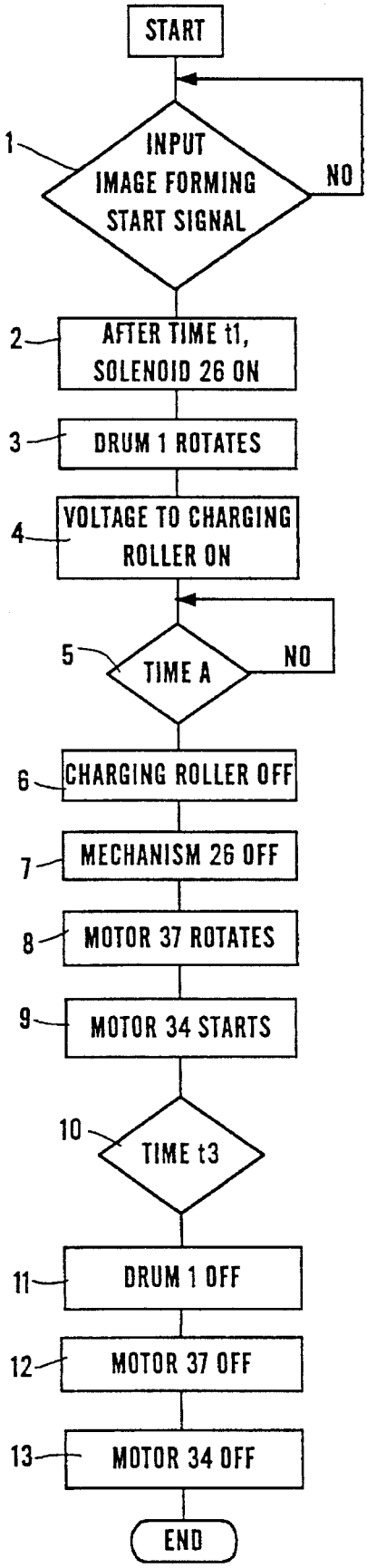
FIG. 17 is a flow chart showing the control function of the microcomputer in FIG. 16.
Figure 18:
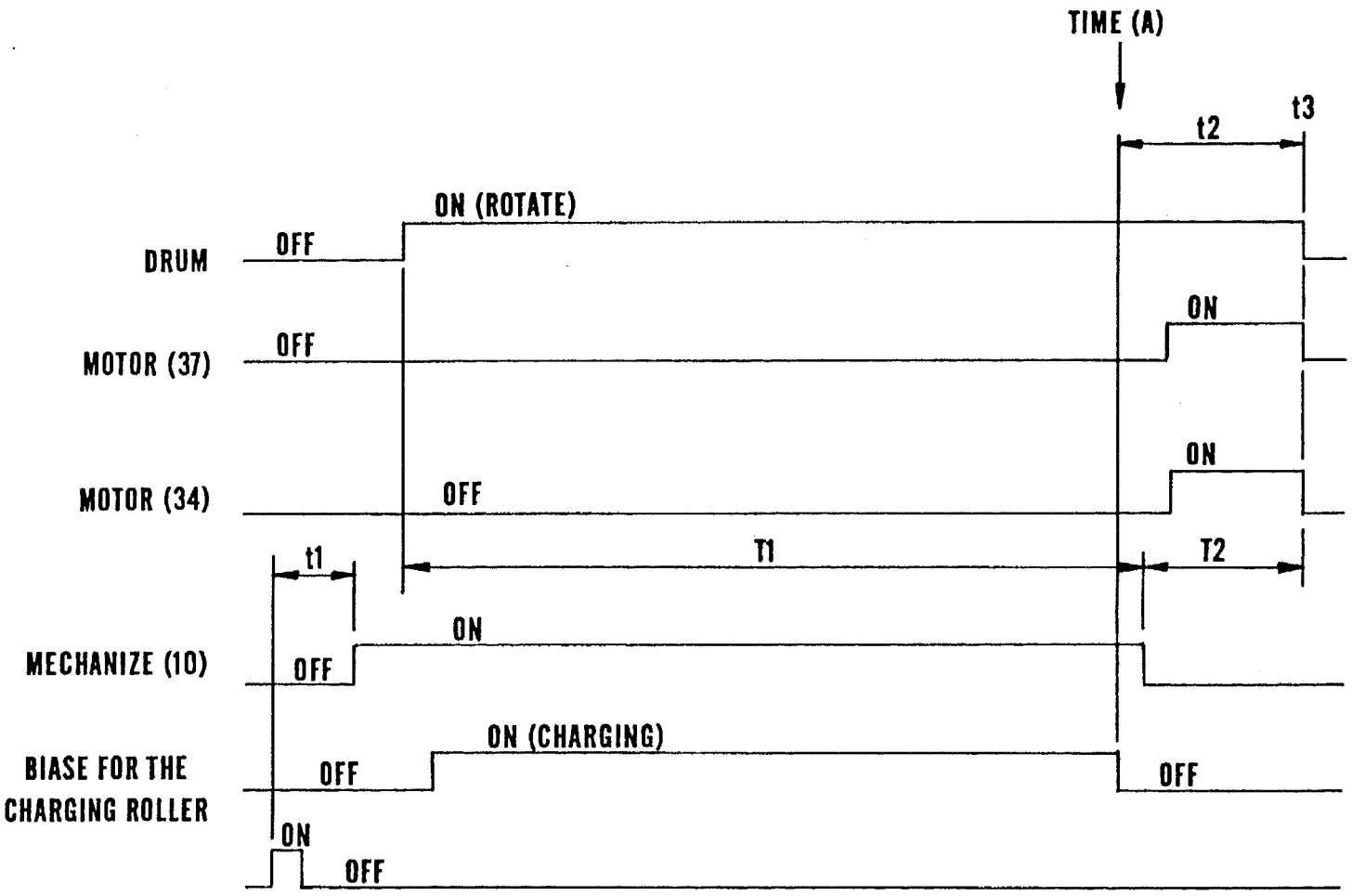
FIG. 18 is a timing chart showing operation of the FIG. 15A embodiment of the present invention.

With reference now to FIG. 17 and the timing charge shown in FIG. 18, after time t1, solenoid 26 is switched on (Block 2) and charging roller 2 is moved into contact with photoconductive drum 1. Next, photoconductive drum 1 rotates (Block 3). Charging roller 1 then charges the surface of the photoconductive drum (Block 4). After time A, photoconductive drum is turned off (Block 5), wherein time (A)=t3−t2. The charging roller is then turned off (Block 6), followed by solenoid mechanism 26 being switched off (Block 7). Next, motor 37 (Block 8) and motor 34 (Block 9) are switched on, thereby initiating cleaning. After time t3, (Block 10), photoconductive drum 1, motor 37 and motor 34 are turned off (Blocks 11, 12, 13, respectively). With reference to FIG. 18, since t1 is greater than t2, the life of the charging roller is extended, thereby providing an additional advantage.

Another embodiment of the present invention is shown in FIGS. 19A–D, wherein charging roller 2 is shown in contact with cleaning element 19, the arrow thereon indicating the directions of reciprocating movement effected by an assemblage of gears to which cleaning element 19 is connected. The assemblage of gears comprises swing lever 41 and swing arm 31 having a fixed pivot point at 81, gear 61 coupled to eccentric swing cam 51, and driving gear 71 driven by a motor (not shown) about shaft 91.

Figure 19A:
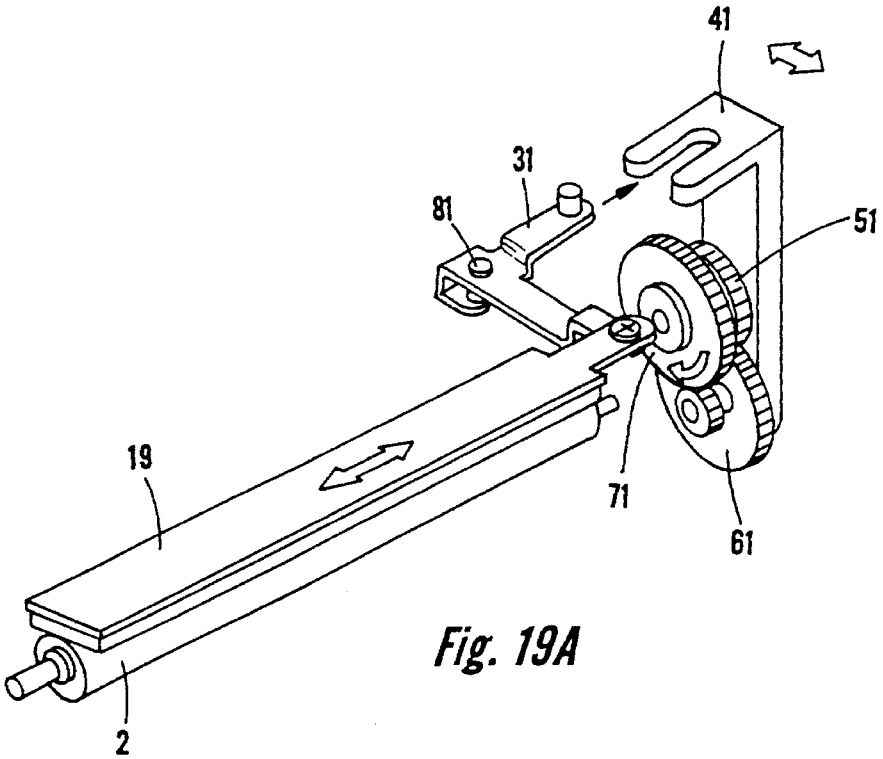
FIGS. 19A, 19B, 19C and 19D show portions of an image forming apparatus directed to another embodiment of the present invention.
Figure 19B:
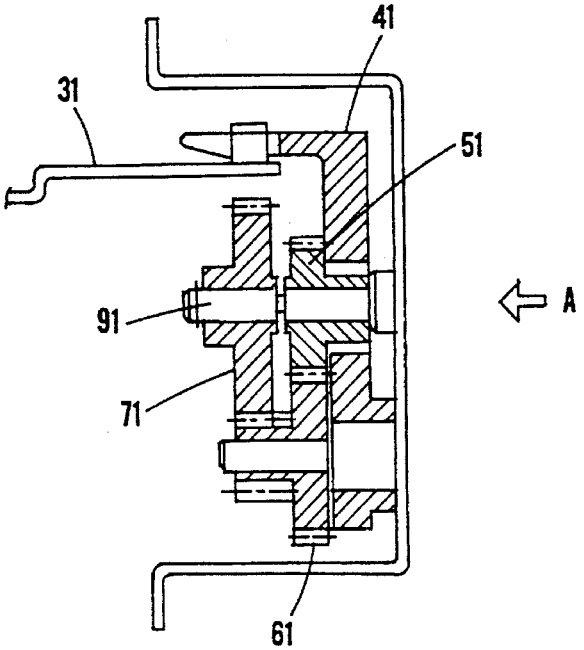
Figure 19C:
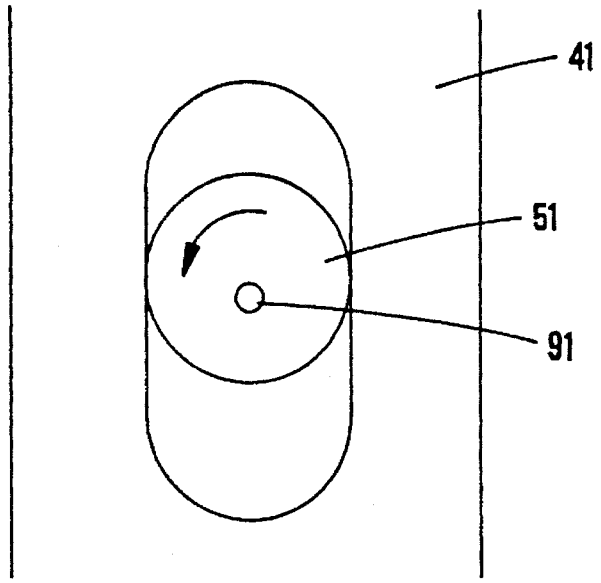
Figure 19D:
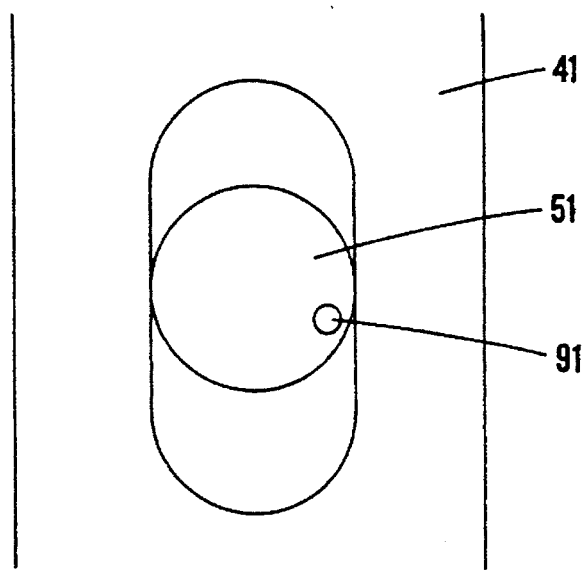

As best seen in FIGS. 19C and D, swing cam 51 rotates about a fixed pivot point and, since it is entrapped within swing arm 41, causes swing arm 41 to oscillate. Thus, linkage 3 functions as an oscillatory to linear translator.

Figure 6A:
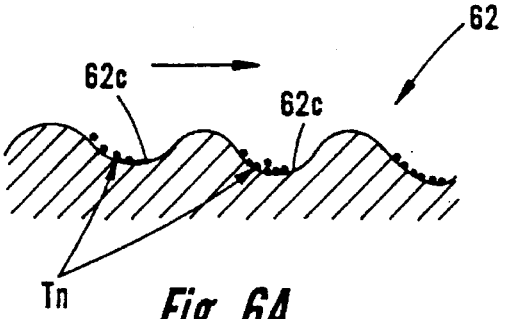
Fig. 6A (PRIOR ART)
FIGS. 6A and 6B show enlarged representations of the surface of a charging roller and accumulated contamination of the prior art and the invention, respectively.
Figure 6B:
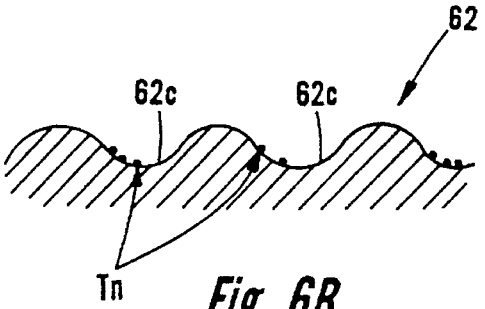

There accordingly has been described unique mechanisms and methodology for cleaning a charging roller of various debris and contamination that tends to adhere to it, by contacting a cleaning element to the roller and imparting lineal as well as rotary motion to one, the other or both the roller and element. As a result, there is considerable improvement in the ability of the cleaning element to remove debris from the surface of the roller, particularly in the surface crevices, and the like, as shown in FIG. 6B. In the environment of an electrophotographic apparatus wherein the roller is a contact charging element for a photoconductive drum, cleaning of the charging roller is inhibited during sensitive portions of a photocopy cycle.

The foregoing embodiments are merely exemplary and not to be construed as limiting the basic concept of effecting relative lineal movement between charge inducing and cleaning element in a variety of electrostatic type apparatuses including, but not limited to, copiers, printers, facsimile machines, etc. Moreover, while charging rollers and photoconductive drums have been exemplified, the invention is not so limited, and can easily be applied to other shapes, e.g., photoconductive belts.

We claim:

1. An apparatus comprising:

a charge receiving member upon which an electrostatic charge is to be formed;

an electric charge inducing member for inducing an electric charge on said charge receiving member;

a cleaning element for cleaning said charge inducing member; and motion imparting means for maintaining said cleaning element and said charge inducing member in contact with each other while imparting relative lineal motion between them, including means for moving said charge inducing member into contact with only one or the other of said charge receiving member and said cleaning element at a time.

2. An apparatus comprising:

a charge receiving member upon which an electrostatic charge is to be formed;

an electric charge inducing member for inducing an electric charge on said charge receiving member;

a cleaning element for cleaning said charge inducing member; and motion imparting means for maintaining said cleaning element and said charge inducing member in contact with each other while imparting relative lineal motion between them, wherein said charge inducing member is elongated and maintained stationary in an axial direction thereof while said cleaning element is moved in a substantially axial direction by said motion imparting means, and wherein said charge inducing member is rotated by said motion imparting means at least while said charge inducing member is in contact with said cleaning element.

3. An apparatus comprising:

a charge receiving member upon which an electrostatic charge is to be formed;

an electric charge inducing member for inducing an electric charge on said charge receiving member;

a cleaning element for cleaning said charge inducing member; and motion imparting means for maintaining said cleaning element and said charge inducing member in contact with each other while imparting relative lineal motion between them, wherein said charge inducing member is elongated and maintained stationary in an axial direction thereof while said cleaning element is moved in a substantially axial direction by said motion imparting means, and wherein said motion imparting means includes a bracket for holding said cleaner, and a cam coupled to said charge inducing member and configured to substantially axially reciprocate said cleaning element during rotation of said charge inducing member.

4. The apparatus of claim 3, wherein a portion of said bracket contacts a groove formed in an outer surface of said cam.

5. The apparatus of claim 4, including a clutch between said cam and said charge inducing member and operative to selectively decouple them.

6. An apparatus comprising:

a charge receiving member upon which an electrostatic charge is to be formed;

an electric charge inducing member for inducing an electric charge on said charge receiving member;

a cleaning element for cleaning said charge inducing member; and motion imparting means for maintaining said cleaning element and said charge inducing member in contact with each other while imparting relative lineal motion between them, wherein said charge inducing member is a roller, and said motion imparting means includes a motor means for rotating said charge inducing roller while moving said cleaning element in a substantially axial direction.

7. The apparatus of claim 6, wherein said motor means includes a first motor for imparting rotation to said charge inducing roller and a second motor for imparting lineal movement to said cleaning element.

8. The apparatus of claim 7, including means for moving said charge inducing member into contact with only one or the other of said charge receiving member and said cleaning element at a time, and for operating said first and second motors only when said charge inducing member and said cleaning element are in contact with each other.

9. The apparatus of claim 7, wherein said second motor is connected to a cam coupled and configured to impart substantially axial reciprocal movement to said cleaning element when said second motor is operated.

10. An apparatus comprising:

a charge receiving member upon which an electrostatic charge is to be formed;

an electric charge inducing member for inducing an electric charge on said charge receiving member;

a cleaning element for cleaning said charge inducing member; and motion imparting means for maintaining said cleaning element and said charge inducing member in contact with each other while imparting relative lineal motion between them, wherein said motion imparting means includes means for rotating said charge inducing member while substantially axially reciprocating said cleaning element.

11. The apparatus of claim 10, wherein said cleaning element is reciprocated non-integrally with respect to the cycles of rotation of said charge inducing member.

12. The apparatus of claim 11, wherein one revolution of said charge inducing member corresponds to about 2.5 bidirectional strokes of said cleaning element.

13. The apparatus of claim 10, wherein the axial length of said cleaning element is greater than that of said charge inducing member and is positioned with respect thereto such that said cleaning element always extends to or beyond the ends of the charge inducing member during cleaning.

14. The apparatus of claim 10, wherein the speed of relative motion in one axial direction is greater than that in the other.

15. An apparatus comprising:

a charge receiving member upon which an electrostatic charge is to be formed;

an electric charge inducing member for inducing an electric charge on said charge receiving member;

a cleaning element for cleaning said charge inducing member; and motion imparting means for maintaining said cleaning element and said charge inducing member in contact with each other while imparting relative lineal motion between them, wherein said charge inducing member is elongated and maintained stationary in an axial direction thereof while said cleaning element is moved in a substantially axial direction by said motion imparting means, and wherein said motion imparting means comprises a cam configured for rotating eccentrically about a fixed center of rotation, a swing lever coupled to said cam for oscillating laterally in response to rotation of said cam, and a linkage between said swing lever and said cleaning element for imparting substantially axial reciprocation to said cleaning element in response to oscillation of said swing lever.

16. An electrostatic image forming apparatus, comprising:

a photoconductive drum upon which an electrostatic latent image is to be formed;

a toner dispenser for transferring a toner to said photoconductive drum;

an electric charge inducing roller;

charge inducing roller positioning means for positioning said charge inducing roller in contact with said photoconductive drum;

a source of electrical potential for establishing an electric field between said charge inducing roller and said photoconductive drum;

means for advancing a piece of paper to said photoconductive drum and for transferring a toner image corresponding to said latent image from said photoconductive drum to said piece of paper;

a cleaning element for cleaning said charge inducing roller; and motion imparting means for maintaining said cleaning element and said charge inducing roller in contact with each other while imparting relative lineal motion between them.

17. The apparatus of claim 16, wherein:

said cleaning element and said photoconductive drum are spaced apart from each other by a distance greater than the diameter of said charge inducing roller;

said motion imparting means includes means for positioning said charge inducing roller in contact with only one or the other of said photoconductive drum and said cleaning element at a time;

said electric field is established between said charge inducing roller and said photoconductive drum only when said charge inducing roller and said photoconductive drum are in contact with each other, and said motion imparting means imparts said relative substantially axial motion only when said charge inducing roller and said cleaning element are in contact with each other.

18. The apparatus of claim 17, including:

means for rotating said photoconductive drum;

wherein said motion imparting means imparts relative substantially axial motion between said cleaning element and said charge inducing roller during only a phase of each cycle of rotation of the photoconductive drum.

19. The apparatus of claim 18, wherein said motion imparting means does not impart relative substantially axial motion between said cleaning element and said charge inducing member during the exposure, development and/or transfer phases of the cycle of rotation of said photoconductive drum.

20. The apparatus of claim 18, wherein said charge inducing roller is stationary in its axial direction, and said cleaning element is moved substantially axially.

21. The apparatus of claim 20, wherein said cleaning element has a length greater than the length of said charge inducing roller and is positioned with respect thereto such that said cleaning element always extends to or beyond the ends of the charge inducing roller during cleaning.

22. The apparatus of claim 20, wherein said cleaning element has a length equal to or less than the length of said charge inducing roller, and is positioned with respect thereto such that said cleaning element always extends, during cleaning, to or beyond the region of said charge inducing roller corresponding to an image forming portion of said conductive drum.

23. The apparatus of claim 18, wherein said charge inducing roller is electrically conductive, the motion imparting means includes means for rotating said charge inducing roller, and strokes of axial movement of said cleaning element are non-integral with the cycles of rotation of said charge inducing roller.

24. The apparatus of claim 18, wherein the strokes of movement of said cleaning element are of a repetition rate greater than the cycles of rotation of said charge inducing roller.

25. The apparatus of claim 24, wherein the strokes of movement of said cleaning element occur on the order of 2.5 that of the cycles of rotation of said charge inducing roller.

26. The apparatus of claim 16, wherein the substantially axial movement is bidirectional.

27. The apparatus of claim 26, wherein the speed of movement of said cleaning element in one substantially axial direction is greater than that in the opposite direction.

28. The apparatus of claim 16, wherein said motion imparting means comprises a first motor for rotating said charge inducing roller and a second motor for imparting substantially axial motion to said cleaning element during rotation of said roller.

29. The apparatus of claim 28, wherein said second motor engages said cleaning element only when said cleaning element and said charge inducing roller are in contact with each other.

30. The apparatus of claim 28, wherein said charge inducing roller is mounted to a supporting arm, and said motion imparting means includes a solenoid for rotating said supporting arm to pivot said charge inducing roller selectively into contact with only one or the other of said cleaning element and said photoconductive drum at a time.

31. The apparatus of claim 16, wherein said motion imparting means comprises a motor, and means coupled thereto for rotating said charge inducing roller and simultaneously imparting substantially axial motion to said cleaning element.

32. The apparatus of claim 16, wherein said motion imparting means comprises, at one end of said charge inducing roller, a cam surface, and said cleaning element is mounted to a support bracket coupled to said cam surface, the shape of said cam surface controlling movement of said cleaning element during rotation of said charge inducing roller.

33. The apparatus of claim 32, wherein said cam surface comprises a circumferential groove in which a part of said support bracket is slidably engaged.

34. The apparatus of claim 32, wherein said cam surface is a patterned end surface of said cam against which a part of said support bracket is urged.

35. The apparatus of claim 32, wherein said cam surface is configured so that said cleaning element does not reciprocate linearly during exposure, development and/or transfer.

36. The apparatus of claim 32, wherein said cam surface is configured so that said cleaning element moves at different speeds in opposite lineal directions.

37. The apparatus of claim 16, wherein said motion imparting means comprises an electric motor rotating a cam having a cam surface, said cleaning element including a protruding member, said cam surface contacting the protruding member of said cleaning element such that rotation of said motor imparts motion to said cleaning element in accordance with the shape of said cam surface.

38. The apparatus of claim 16, wherein said motion imparting means comprises a cam configured for rotating eccentrically about a fixed center of rotation, a swing lever coupled to said cam for oscillating laterally in response to rotation of said cam, and a linkage between said swing lever and said cleaning element for imparting substantially axial reciprocation to said cleaning element in response to oscillation of said swing lever.

39. The apparatus of claim 16, wherein said charge inducing roller is caused to rotate by contact with said photoconductive drum, and wherein said motion imparting means comprises a bracket affixed to said cleaning element, said bracket having a bent portion which slidably engages a patterned circumferential groove in a cam attached to said photoconductive drum, the pattern of said circumferential groove determining the relative lineal movement of said cleaning element during rotation of said photoconductive drum.

40. The apparatus of claim 39, further comprising a clutch between said photoconductive drum and said cam for engaging and disengaging said cam and said photoconductive drum, so that the cleaning element is caused to reciprocate linealy during selected phases of rotation of said photoconductive drum.

41. The apparatus of claim 16, wherein said motion imparting means comprises a first motor for driving, by means of a series of gears, said charge inducing roller, a second motor for linealy reciprocating said cleaning element, a bracket affixed to said cleaning element, a cam having a predetermined circumferential groove driven by said second motor, a part of said bracket slidably engaging said circumferential groove designed to cause the cleaning element to move at different velocities in opposite lineal directions.

42. The apparatus of claim 41, further comprising a solenoid having a retractable arm connected by a spring to a pivotable bar affixed to said charge inducing roller, said solenoid capable of moving said charge inducing roller into contact with said photoconductive drum and out of contact with said cleaning element for charging said photoconductive drum, said solenoid also capable of moving said charge inducing roller out of contact with said photoconductive drum and into contact with said cleaning element whereupon said first motor is activated to impart rotational movement to said charge inducing roller while said second motor imparts reciprocating lineal movement to said charge inducing element.

43. The apparatus of claim 16, wherein said motion imparting means comprises a first motor for driving said charge inducing roller by means of a series of gears, a second motor, a cam having a profiled surface connected to said second motor, a bracket affixed to said cleaning element, a portion of said bracket urged against the profiled surface of said cam by a spring, wherein said profiled surface causes said cleaning element to move at different velocities in opposite directions.

44. The apparatus of claim 43, further comprising a solenoid having a retractable arm connected by a spring to a pivotable bar affixed to said charge inducing roller, said solenoid capable of moving said charge inducing roller into contact with said photoconductive drum and out of contact with said cleaning element for charging said photoconductive drum, said solenoid also capable of moving said charge inducing roller out of contact with said photoconductive drum and into contact with said cleaning element whereupon said first motor is activated to impart rotational movement to said charge inducing roller while said second motor imparts reciprocating lineal movement to said charge inducing element.

45. An electrostatic image forming method comprising:

establishing an electric field between a charge inducing member and a photoconductive member, charging said photoconductive member with said electric charge inducing member positioned in contact with said photoconductive member, forming an electrostatic latent image on said photoconductive member, dispensing a toner to the photoconductive member from a toner dispenser to develop said electrostatic latent image, advancing a sheet of paper to said photoconductive member, transferring the toner developed latent electrostatic image from said photoconductive member to said sheet of paper, and cleaning said charge inducing member by:

positioning a cleaning element in contact with said charge inducing member and establishing relative substantially axial movement between said cleaning element and said charge inducing member.

46. The method of claim 45, wherein said photoconductive member is a drum, and said charge inducing member is a roller.

47. The method of claim 46, wherein said cleaning also comprises establishing relative rotational movement between said cleaning element and said charge inducing roller.

48. The method of claim 46, wherein said charge inducing roller is axially stationary during cleaning.

49. The method of claim 46, wherein said cleaning element is reciprocated with strokes that are non-integral with the cycles of rotation of said charge inducing roller.

50. The method of claim 46, wherein said substantially axial movement is bidirectional.

51. The method of claim 50, wherein one revolution of said charge inducing roller corresponds to about 2.5 bidirectional strokes of movement of said cleaning element.

52. The method of claim 46, wherein the axial length of said cleaning element is greater than that of said charge inducing roller, and is positioned and reciprocated with respect thereto such that said cleaning element always extends to or beyond the ends of the charge inducing roller during cleaning.

53. The method of claim 46, wherein the speed of movement of the cleaning element in one substantially axial direction is greater than that in the opposite direction.

* * * * *